US011969014B2

(12) United States Patent
Qiu et al.

(10) Patent No.: US 11,969,014 B2
(45) Date of Patent: Apr. 30, 2024

(54) ELECTRONIC CIGARETTE

(71) Applicant: CHANGZHOU PATENT ELECTRONIC TECHNOLOGY CO., LTD, Changzhou (CN)

(72) Inventors: Weihua Qiu, Jiangsu (CN); Wanlin Cai, Jiangsu (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 568 days.

(21) Appl. No.: 17/319,111

(22) Filed: May 13, 2021

(65) Prior Publication Data

US 2021/0259313 A1 Aug. 26, 2021

Related U.S. Application Data

(63) Continuation-in-part of application No. PCT/CN2019/114957, filed on Nov. 1, 2019.

(30) Foreign Application Priority Data

Nov. 14, 2018 (CN) ..... 201821876120.8

(51) Int. Cl.
*A24F 40/46* (2020.01)
*A24F 40/10* (2020.01)
*A24F 40/51* (2020.01)

(52) U.S. Cl.
CPC ..... *A24F 40/46* (2020.01); *A24F 40/10* (2020.01); *A24F 40/51* (2020.01)

(58) Field of Classification Search
USPC ..... 131/329
See application file for complete search history.

(56) References Cited

U.S. PATENT DOCUMENTS 9,226,525 B2 * 1/2016 Liu ..... H05B 1/0202
9,861,127 B2 * 1/2018 Liu ..... A24F 40/60
(Continued)

FOREIGN PATENT DOCUMENTS

CN 203873018 U 10/2014
CN 206453252 U 9/2017
(Continued)

OTHER PUBLICATIONS

International Search Report of PCT Patent Application No. PCT/CN2019/114967 dated Feb. 6, 2020.

*Primary Examiner* — Harshad C Patel
(74) *Attorney, Agent, or Firm* — Andrew C. Cheng

(57) ABSTRACT

An electronic cigarette includes a main body, a base assembly, an atomizing assembly, a power supply device and a cigarette lighting device. The main body forms an accommodating cavity therein. The base assembly is movably arranged on the main body. The atomizing assembly is connected with the base assembly and is movably received in the accommodating cavity under the driving of the base assembly. A first triggering member is installed on the main body, a second triggering member is installed on the base assembly. When the atomizing assembly is received in the accommodating cavity, the first triggering member and the second triggering member form a first relationship of a triggering state. When the atomizing assembly moves out of the accommodating cavity, the first triggering member and the second triggering member form a second relationship of a disconnected state.

20 Claims, 5 Drawing Sheets

(56) References Cited

U.S. PATENT DOCUMENTS

| | | | | |
|---|---|---|---|---|
| 11,425,931 | B2 * | 8/2022 | Harrison | A24F 7/02 |
| 11,666,088 | B2 * | 6/2023 | Harrison | A24F 40/485 131/329 |
| 2004/0020500 | A1 * | 2/2004 | Wrenn | A24C 5/606 131/194 |
| 2014/0202454 | A1 * | 7/2014 | Buchberger | A61M 15/06 128/200.14 |
| 2015/0090256 | A1 * | 4/2015 | Chung | A61M 15/002 128/202.21 |
| 2015/0173421 | A1 * | 6/2015 | Hsieh | A24F 40/50 200/43.01 |
| 2016/0295919 | A1 * | 10/2016 | Thomas, Jr. | A61M 11/042 |
| 2017/0215478 | A1 | 8/2017 | Harrison et al. | |
| 2019/0307174 | A1 * | 10/2019 | Qiu | B67D 7/0288 |
| 2019/0328044 | A1 * | 10/2019 | Qiu | A24F 40/42 |
| 2020/0163381 | A1 * | 5/2020 | Qiu | A24F 40/44 |

FOREIGN PATENT DOCUMENTS

| | | | |
|---|---|---|---|
| CN | 206651397 | U | 11/2017 |
| CN | 207322683 | U | 5/2018 |
| CN | 108713798 | A | 10/2018 |
| CN | 208064485 | U | 11/2018 |
| CN | 209420955 | U | 9/2019 |

* cited by examiner

ELECTRONIC CIGARETTE

CROSS-REFERENCE TO RELATED APPLICATIONS

This application is a continuation-in-part of International Patent Application No. PCT/CN2019/114957, filed on Nov. 1, 2019, entitled "electronic cigarette", which claims priority to Chinese Patent Application No. 201821876120.8, filed on Nov. 14, 2018. The aforementioned patent applications are hereby incorporated by reference in their entireties.

TECHNICAL FIELD

The present disclosure relates to the technical field of electronic cigarette, and more particularly, relates to an electronic cigarette.

BACKGROUND

Existing baking type electronic cigarettes generally directly heat a metal smoking pan or a ceramic smoking pan filled with a smoke forming substance (for example, tobacco, tobacco shred, tobacco paste or e-liquid, etc.), to atomize the smoke forming substance into smoke, and the smoke can be inhaled by the user. However, it is very easy to accidentally trigger the cigarette lighting device when filling the smoking pan with a smoke forming substance, so that heat is generated after the smoking pan is energized, which may cause scalding to the user.

SUMMARY

In view of the above, it is necessary to provide an electronic cigarette which can prevent the user from being scalded when it is filled with a smoke forming substance.

The technical solution adopted by the present disclosure to solve its technical problems is as follows.

An electronic cigarette includes a main body, a base assembly, an atomizing assembly, a power supply device and a cigarette lighting device. The main body forms an accommodating cavity therein. The base assembly is movably arranged on the main body. The atomizing assembly is connected with the base assembly and is movably received in the accommodating cavity under the driving of the base assembly. A first triggering member is installed on the main body, a second triggering member is installed on the base assembly. When the atomizing assembly is received in the accommodating cavity, the first triggering member and the second triggering member form a first relationship of a triggering state. When the atomizing assembly moves out of the accommodating cavity, the first triggering member and the second triggering member form a second relationship of a disconnected state. When the first triggering member and the second triggering member are in the triggering state and the cigarette lighting device is triggered at the same time, the power supply device electrically drives the atomizing assembly.

In one embodiment, the first triggering member is a Hall switch, and the second triggering member is a magnetic body. The cigarette lighting device, the power supply device, the Hall switch and the atomizing assembly are connected in series. When the first triggering member and the second triggering member switch from the second relationship to the first relationship, the magnetic body gradually approaches the Hall switch and triggers the Hall switch to be closed.

In one embodiment, both the first triggering member and the second triggering member are electrical conductors. The cigarette lighting device, the power supply device, the two electrical conductors and the atomizing assembly are connected in series. When the two electrical conductors gradually approach and then come into contact with each other, the first triggering member and the second triggering member switch from the second relationship to the first relationship.

In one embodiment, the main body includes a bottom cover, the base assembly includes a base, the first triggering member is installed on the bottom cover, the second triggering member is installed on the base, and the base is slidable or rotatable relative to the bottom cover.

In one embodiment, a rotating shaft is provided on the bottom cover, a shaft hole is provided in the base corresponding to the rotating shaft, and the rotating shaft is rotatably connected with the shaft hole; or, a sliding block is provided on the bottom cover, a sliding groove is provided in the base corresponding to the sliding block, and the sliding block is slidably connected with the sliding groove.

In one embodiment, the cigarette lighting device is a push switch or a capacitive touch switch installed outside the main body; or, the electronic cigarette is provided with a sensing air passage and a controller, the cigarette lighting device is a sensor installed in the sensing air passage, wherein the sensor, the power supply device and the controller are electrically connected.

In one embodiment, the main body is provided with a mounting notch communicating with the accommodating cavity. The atomizing assembly enters the accommodating cavity through the mounting notch or moves out of the accommodating cavity through the mounting notch. A blocking wall is provided on the base. The blocking wall is capable of sealing the mounting notch. A smooth transition is present at the junction between the outer surface of the blocking wall and the outer surface of the main body to match with the overall shape of the main body.

In one embodiment, the main body further includes a housing, the housing includes a first casing and a second casing provided on one side of the first casing. The bottom cover is installed in an opening at the lower end of the first casing. A cavity for receiving the power supply device is enclosed jointly by the bottom cover and the first casing. The cigarette lighting device is provided on the first casing. The accommodating cavity is provided in the second casing.

In one embodiment, the atomizing assembly includes smoking pan configured to be received in the accommodating cavity. An atomizing chamber is provided in the smoking pan. The main body includes a smoke outlet pipe in communication with the accommodating cavity.

In one embodiment, the lower end surface of the smoke outlet pipe extends upward along the axial direction of the smoke outlet pipe to form an inner sleeve and an outer sleeve sleeved on the outside of the inner sleeve. A smoke outlet passage is formed between the inner sleeve and the outer sleeve. The lower end of the inner sleeve is in communication with the accommodating cavity. The upper end of the inner sleeve is in communication with the smoke outlet passage. The outer sleeve is provided with a smoke outlet opening in communication with the smoke outlet passage and the inner cavity of the smoke outlet pipe.

In one embodiment, the inner cavity of the smoke outlet pipe contains liquid, and the liquid level of the liquid is higher than the smoke outlet opening and lower than the height of the inner sleeve.

In one embodiment, the first casing is provided with a fixing member located above the second casing, and a connecting member is connected to the top of the second casing. One end of the smoke outlet pipe passes through the fixing member and is then connected to the connecting member.

An electronic cigarette including a main body, a base assembly and an atomizing assembly, wherein:

the main body includes a bottom cover, the bottom cover is installed at a lower end of the main body;

the base assembly includes a base, the base is located below the bottom cover, the atomizing assembly is installed on the base;

an accommodating cavity configured for receiving the atomizing assembly is provided inside the main body, a side wall of the main body is provided with a mounting notch communicating with the accommodating cavity, a blocking wall corresponding to the mounting notch is provided on the base;

the base is rotatable or slidable relative to the bottom cover to switch between a first position and a second position;

in the first position, the atomizing assembly is received in the accommodating cavity and the blocking wall seals the mounting notch;

in the second position, the atomizing assembly is located out of the accommodating cavity for being filled with a smoke forming substance;

when the base rotates or slides relative to the bottom cover to switch between the first position and the second position, the atomizing assembly is driven by the base to enter the accommodating cavity through the mounting notch or move out of the accommodating cavity through the mounting notch.

In one embodiment, a rotating shaft is provided on one of the bottom cover and the base, a shaft hole corresponding to the rotating shaft is provided in the other of the bottom cover and the base, the rotating shaft is rotatably inserted in the shaft hole.

In one embodiment, a mounting groove is provided in an upper surface of the base, the mounting groove is a blind groove, the base assembly further includes an elastic member and a locking member, the elastic member is installed in the mounting groove, one end of the elastic member is connected with a bottom wall of the mounting groove, and the other end of the elastic member is connected with the locking member, two locking grooves are provided in a lower surface of the bottom cover, the locking member rotates together with the base under the driving of the base;

when the locking member is rotated until it is embedded into one of the locking grooves, the atomizing assembly enters the accommodating cavity;

when the locking member is rotated until it is embedded into the other locking groove, the atomizing assembly moves out of the accommodating cavity.

In one embodiment, the lower surface of the bottom cover is provided with an arc-shaped limiting groove around the rotating shaft, the upper surface of the base is protruded to provide with a limiting protrusion, the limiting protrusion is inserted into the limiting groove and can slide along the limiting groove;

when the base is rotated relative to the bottom cover, the limiting protrusion moves from one end of the limiting groove to the other end of the limiting groove.

In one embodiment, a sliding block is provided on one of the bottom cover and the base, a sliding groove corresponding to the sliding block is provided in the other of the bottom cover and the base, the sliding block is slidably disposed in the sliding groove.

In one embodiment, the main body includes a first casing and a second casing provided on one side of the first casing, the bottom cover is installed in an opening at the lower end of the first casing, a cavity for receiving a power supply device is enclosed jointly by the bottom cover and the first casing; the accommodating cavity is provided inside the second casing.

In one embodiment, a lower end of the second casing is flush with the lower end of the first casing, the height of the second casing is smaller than the height of the first casing; the main body further includes a smoke outlet pipe located above the second casing and in communication with the accommodating cavity.

In one embodiment, a lower end surface of the smoke outlet pipe extends upward along an axial direction of the smoke outlet pipe to form an inner sleeve and an outer sleeve sleeved on the outside of the inner sleeve; a smoke outlet passage is formed between the inner sleeve and the outer sleeve; a lower end of the inner sleeve is in communication with the accommodating cavity; an upper end of the inner sleeve is in communication with the smoke outlet passage; an upper end of the outer sleeve is closed, a lower end of a side wall of the outer sleeve is provided with a smoke outlet opening in communication with the smoke outlet passage and an inner cavity of the smoke outlet pipe.

In one embodiment, the main body is provided with a first triggering member, the base assembly is provided with a second triggering member;

when the base rotates or slides relative to the bottom cover to switch from the second position to the first position, the second triggering member gradually approaches the first triggering member to cause the first triggering member to be closed or to contact with the first triggering member;

when the base rotates or slides relative to the bottom cover to switch from the first position to the second position, the second triggering member gradually moves away from the first triggering member to cause the first triggering member to be opened or to not contact with the first triggering member.

In one embodiment, further including a power supply device received in the main body, wherein:

in the first position, the first triggering member and the second triggering member are in a connected state so that the atomizing assembly is electrically connected to the power supply device;

in the second position, the first triggering member and the second triggering member are in a disconnected state so that the atomizing assembly is disconnected from the power supply device.

In one embodiment, further including a cigarette lighting device provided on the main body, wherein:

in the first position, when the cigarette lighting device is triggered, the atomizing assembly is driven by the power supply device to atomize and form smoke;

in the second position, even if the cigarette lighting device is triggered, the atomizing assembly is not able to be driven by the power supply device to atomize and form smoke.

In one embodiment, the first triggering member is a Hall switch, and the second triggering member is a magnetic body; or the first triggering member and the second triggering member are both electrical conductors.

The beneficial effects of the present disclosure are: when the atomizing assembly moves out of the accommodating cavity, the first trigging member and the second trigging member are in a second relationship, and at this time, even if the cigarette lighting device is triggered, the power supply device cannot electrically drive the atomizing assembly, thereby preventing the user from accidentally triggering the cigarette lighting device to scald the user when the user is filling a smoke forming substance, and achieving a safety protection function.

Figure 1:
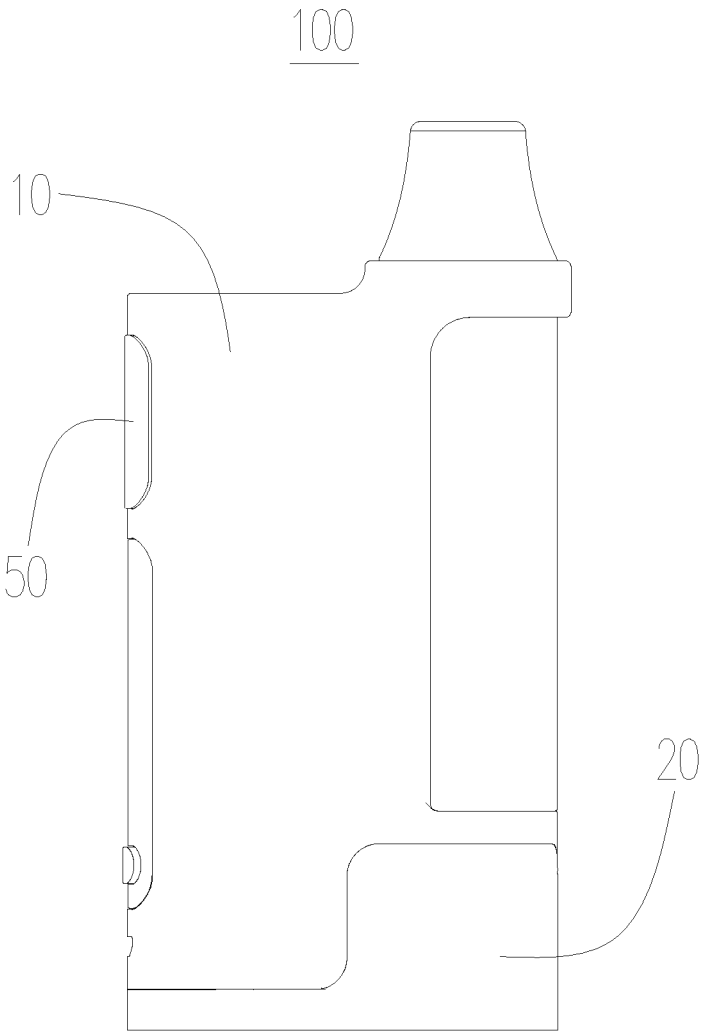
FIG. 1 is a schematic diagram of the structure of an electronic cigarette according to the first embodiment of the present disclosure (showing the state in which the atomizing assembly is received in the accommodating cavity)

The reference numerals for various components in the drawings are as follows:

| | | |
|---|---|---|
| electronic cigarette 100 | main body 10 | housing 11 |
| first casing 111 | second casing 112 | accommodating cavity 110 |
| mounting notch 1121 | bottom cover 12 | rotating shaft 121 |
| locking groove 122 | limiting groove 123 | smoke outlet pipe 13 |
| inner sleeve 131 | outer sleeve 132 | smoke outlet passage 130 |
| smoke outlet opening 133 | air outlet pipe 134 | air outlet opening 135 |
| connecting member 14 | base assembly 20 | base 21 |
| shaft hole 211 | blocking wall 212 | mounting groove 213 |
| limiting protrusion 214 | air inlet opening 215 | elastic member 22 |
| locking member 23 | atomizing assembly 30 | smoking pan 31 |
| atomizing chamber 311 | heating member 32 | power supply device 40 |
| cigarette lighting device 50 | first triggering member 60 | second triggering member 70 |
| sliding block 124 | sliding groove 216 | fixing member 1111 |
| smoke outlet hole 141 | sealing member 142 | fixing seat 216 |
| top opening 217 | side opening 218 | electrode groove 219 |
| elastic electrode 25 | latching groove 2161 | |

DETAILED DESCRIPTION OF PREFERRED EMBODIMENTS

In order to facilitate the understanding of the present disclosure, the present disclosure will be described in details with reference to the accompanying drawings. Preferred embodiments of the present disclosure are given in the drawings. However, the present disclosure can be realized in many different forms and is not limited to the embodiments described herein. On the contrary, the purpose of providing these embodiments is to make a more thorough and comprehensive understanding of the disclosed contents of the present disclosure.

It should be noted that when an element is referred to as being "fixed to" another element, it may be directly on the other element or there may be a centered element. When an element is considered to be "connected" to another element, it can be directly connected to the other element or intervening elements may also be present.

Unless defined otherwise, all technical and scientific terms used herein have the same meaning as commonly understood by one of ordinary skill in the art to which this disclosure belongs. The terms used herein in the description of the present disclosure are only for the purpose of describing specific embodiments, and are not intended to limit the present disclosure. The term "and/or" as used herein includes any and all combinations of one or more of the associated listed items.

First Embodiment

Figure 4:
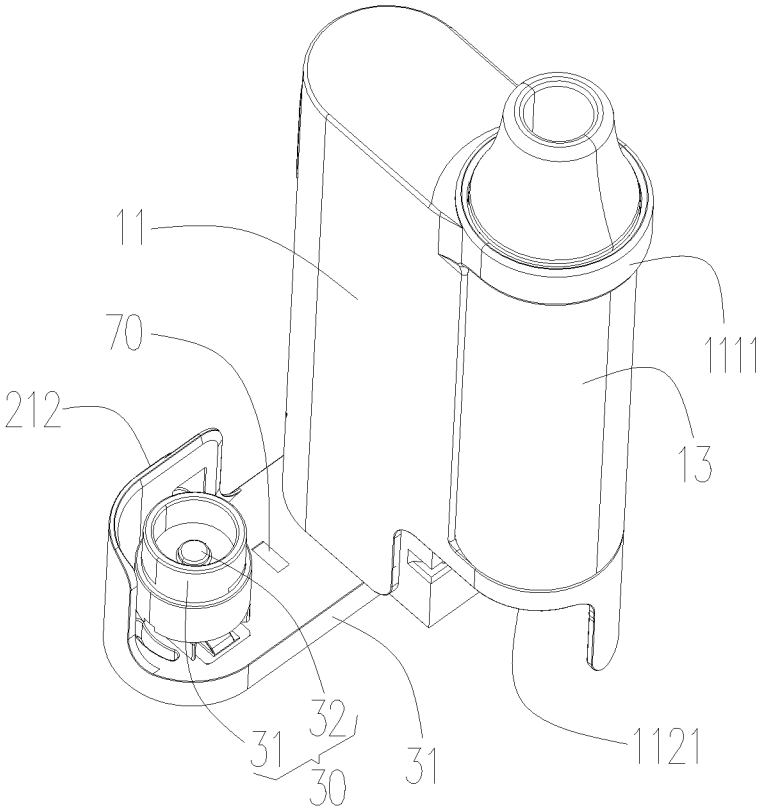
FIG. 4 is a perspective view of the electronic cigarette shown in FIG. 1 (showing the state in which the atomizing assembly is moved out of the accommodating cavity)

Refer to FIGS. 1 and 4, the first embodiment of the present disclosure provides an electronic cigarette 100, which includes a main body 10, a base assembly 20 movably arranged on the main body 10, an atomizing assembly 30 mounted on the base assembly 20, and a power supply device 40 electrically connected to the atomizing assembly 30. In use, the power supply device 40 electrically drives the atomizing assembly 30 to supply power to the atomizing assembly 30, thereby heating the smoke forming substance loaded on the atomizing assembly 30, and atomizing the smoke forming substance to generate smoke, which can be inhaled by the user.

Figure 2:
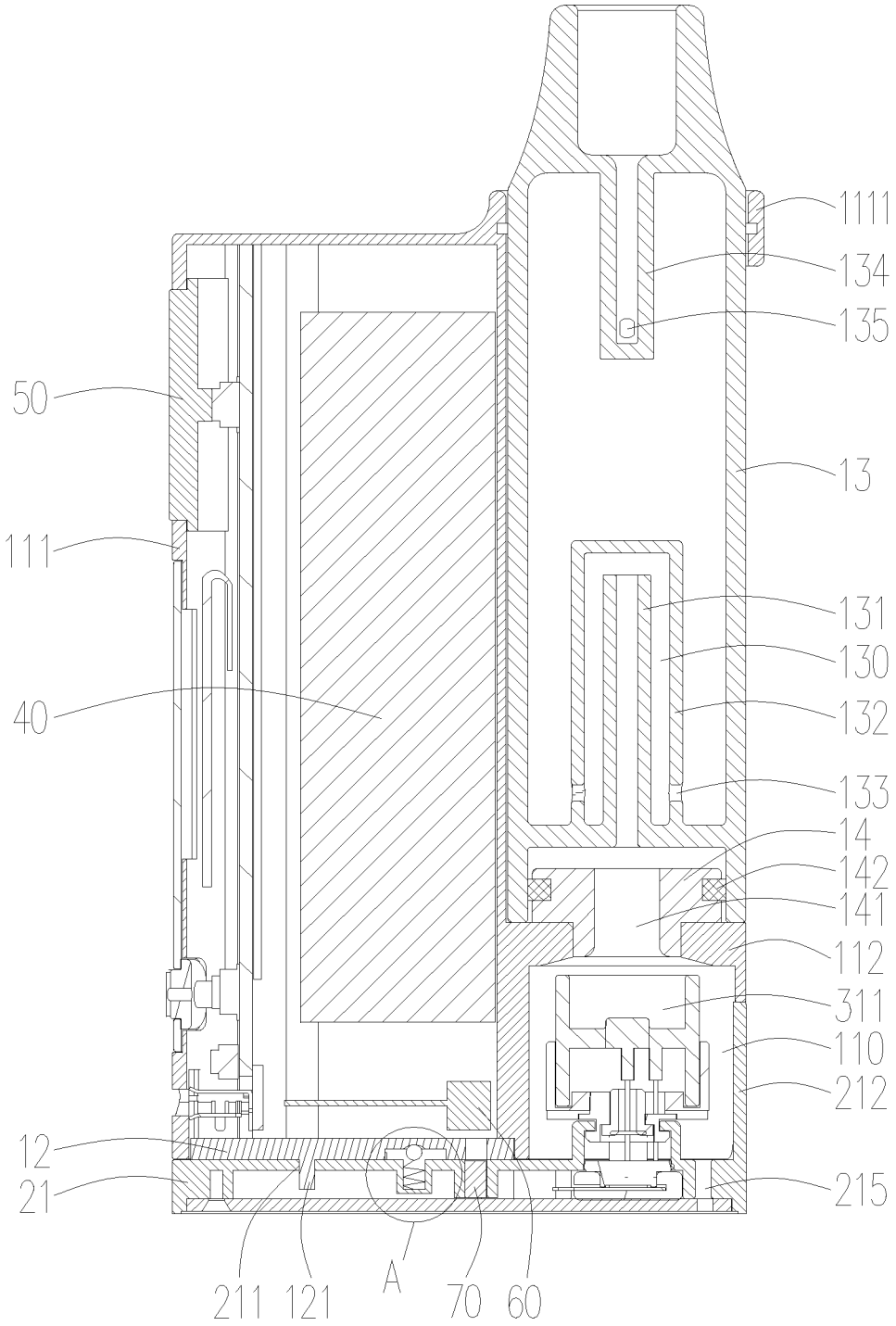
FIG. 2 is a cross-sectional view of the electronic cigarette shown in FIG. 1.

Please refer to FIG. 2, the main body 10 is the main structure of the electronic cigarette. The main body 10 includes a housing 11, a bottom cover 12 installed at the lower end of the housing 11, and a smoke outlet pipe 13 installed at one side of the housing 11.

The housing 11 includes a first casing 111 and a second casing 112 provided on one side of the first casing 111. The first casing 111 is substantially a hollow cylindrical structure with an opening at the lower end thereof. The bottom cover 12 is installed in the opening at the lower end of the first casing 111, so that a cavity (not labelled) is enclosed jointly by the first casing 111 and the bottom cover 12, and the power supply device 40 is received in the cavity. The second casing 112 is substantially a hollow cylindrical structure with both ends being opened. The lower end of the second casing 112 is flush with the lower end of the first casing 111, and the height of the second casing 112 is smaller than the height of the first casing 111. The second casing 112 is aligned with the smoke outlet pipe 13 and located below the smoke outlet pipe 13. The inner cavity of the second casing 112 forms an accommodating cavity 110 for accommodating the atomizing assembly 30. The side wall of the second casing 112 is provided with a mounting notch 1121 communicating with the accommodating cavity 110 and passing through the lower end surface of the second casing 112. During installation, the atomizing assembly 30 is installed in the accommodating cavity 110 through the mounting notch 1121.

Referring to FIGS. 2 and 4, in this embodiment, a ring-shaped fixing member 1111 is provided on the first casing 111. The fixing member 1111 is located above the second casing 112 and sleeved on the outside of the smoke outlet pipe 13 to limit the position of the smoke outlet pipe 13 and prevent the smoke outlet pipe 13 from tilting and slipping off the housing 11. In addition, the outer surface of the first casing 111 that is in contact with the smoke outlet pipe 13 is a concave surface with a shape matching with the profile of the smoke outlet pipe 13, to prevent the smoke outlet pipe 13 from easily moving away. Meanwhile, when the smoke outlet pipe 13 is inserted into or pulled out, the concave surface of the first casing 111 guides the smoke outlet pipe 13 to facilitate the user to install the smoke outlet pipe 13.

The smoke outlet pipe 13 is substantially a hollow cylindrical structure. The lower end of the smoke outlet pipe 13 is connected with the opening at the upper end of the second casing 112, the upper end of the smoke outlet pipe 13 extends upward along the axial direction of the smoke outlet pipe 13 and protrudes above the upper end surface of the first casing 111. In use, the user's mouth touches the part of the smoke outlet pipe 13 protruding above the upper end surface of the first casing 111, thereby facilitating the suction.

The lower end surface of the smoke outlet pipe 13 extends upward along the axial direction of the smoke outlet pipe 13 to form an inner sleeve 131 and an outer sleeve 132. The outer sleeve 132 is sleeved outside the inner sleeve 131. A smoke outlet passage 130 is formed between the outer wall of the inner sleeve 131 and the inner wall of the outer sleeve 132. The lower end of the inner sleeve 131 extends through the lower end surface of the smoke outlet pipe 13 and is in communication with the accommodating cavity 110. The upper end of the inner sleeve 131 is provided with an opening (not labelled) in communication with the smoke outlet passage 130. The upper end of the outer sleeve 132 is closed. The lower end of the side wall of the outer sleeve 132 is provided with a smoke outlet opening 133 in communication with the smoke outlet passage 130 and the inner cavity of the smoke outlet pipe 13. Therefore, the smoke flowing into the smoke outlet passage 130 needs to downwardly flow back before it can flow out from the smoke outlet opening 133, thereby prolonging the airflow path. The upper end surface of the smoke outlet pipe 13 extends downward along the axial direction of the smoke outlet pipe 13 to form an air outlet pipe 134. The upper end of the air outlet pipe 134 extends through the upper end surface of the smoke outlet pipe 13. An air outlet opening 135 is defined in the side wall at the lower end of the air outlet pipe 134, and the air outlet opening 135 is in communication with the inner cavity of the air outlet pipe 134 and the inner cavity of the smoke outlet pipe 13.

In addition, the inner cavity of the smoke outlet pipe 13 contains liquid, the liquid level of the liquid is higher than the smoke outlet opening 133 and lower than the height of the inner sleeve 131, therefore, the smoke flowing out through the smoke outlet opening 133 needs to pass through the liquid to finally enter the user's mouth. On the one hand, the liquid can filter the impurities in the smoke; on the other hand, when the smoke flows through the liquid, part of the heat of the smoke is absorbed by the liquid, thereby reducing the temperature of the smoke when it enters the user's mouth and preventing the user from being scalded. In this embodiment, the liquid placed in the smoke outlet pipe 13 is water. In can be understood, in other embodiments, the liquid may also be other solutions.

When the atomizing assembly 30 is working, the smoke forming substance is atomized to generate smoke under the action of heating, and the smoke is filled in the accommodating cavity 110. Under the user's suction, the smoke enters the user's mouth through the inner cavity of the inner sleeve 131, the smoke outlet passage 130, the smoke outlet opening 133, the inner cavity of the smoke outlet pipe 13, the air outlet opening 135 and the air outlet pipe 134 sequentially. In this way, the flow path of the smoke is prolonged, the diffusion effect of the heat in the smoke is improved, the temperature of the smoke is not too high when the smoke enters the user's mouth, and the user is prevented from being scalded. In addition, since the outer sleeve 132 and the air outlet pipe 134 have the function of blocking the flowing of the smoke, it prevents the impurities in the smoke from directly entering the user's mouth. When the smoke forming substance is e-liquid, it can also prevent the fine e-liquid particles from entering the user's mouth due to splashing.

In addition, the smoke outlet pipe 13 and the second casing 112 are connected by a connecting member 14. Specifically, the connecting member 14 is substantially a sleeve-like structure with two ends being opened. The inner cavity of the connecting member 14 forms a smoke outlet hole 141. The lower end of the connecting member 14 is inserted into the top of the second casing 112, and the smoke outlet hole 141 is in communication with the accommodating cavity 110. The upper end of the connecting member 14 protrudes to the outside of the accommodating cavity 110, the lower end of the smoke outlet pipe 13 is sleeved on the outside of the upper end of the connecting member 14, and the smoke outlet hole 141 is in communication with the inner cavity of the inner sleeve 131. In this way, the upper and lower ends of the smoke outlet pipe 13 are respectively restricted and fixed by the fixing member 1111 and the connecting member 14, to ensure the mechanical connection and realize the function of air ventilation at the same time. That is, when the smoke outlet pipe 13 is installed, one end of the smoke outlet pipe 13 passes through the fixing member 1111 and is then connected to the connecting member 14. In order to prevent the smoke from leaking from the junction between the smoke outlet pipe 13 and the connecting member 14, a sealing member 142 is sandwiched between the smoke outlet pipe 13 and the connecting member 14. Understandably, the material of the sealing member 142 includes, but is not limited to, silicone or rubber.

Figure 3:
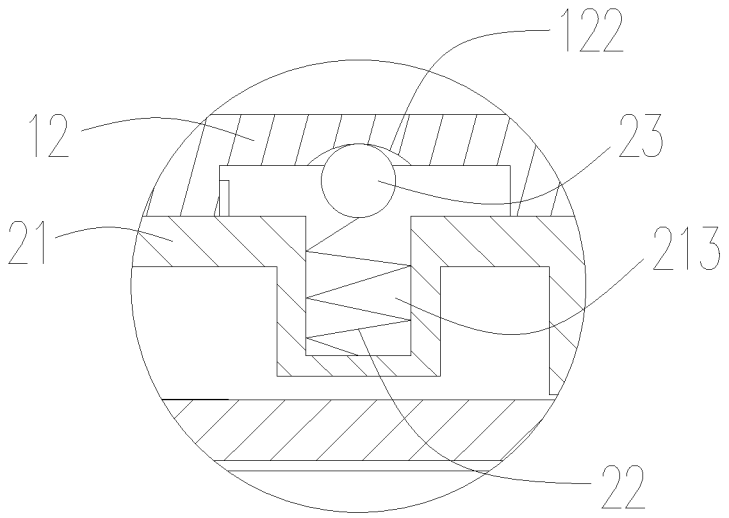
FIG. 3 is a partially enlarged view of the portion A in the electronic cigarette shown in FIG. 2.

Please refer to FIGS. 2 and 3, in this embodiment, the base assembly 20 is rotatably mounted to the main body 10. Specifically, the base assembly 20 includes a base 21 which is rotatably connected to the bottom cover 12, and an elastic member 22 and a locking member 23 both of which are installed on the base 21.

Figure 5:
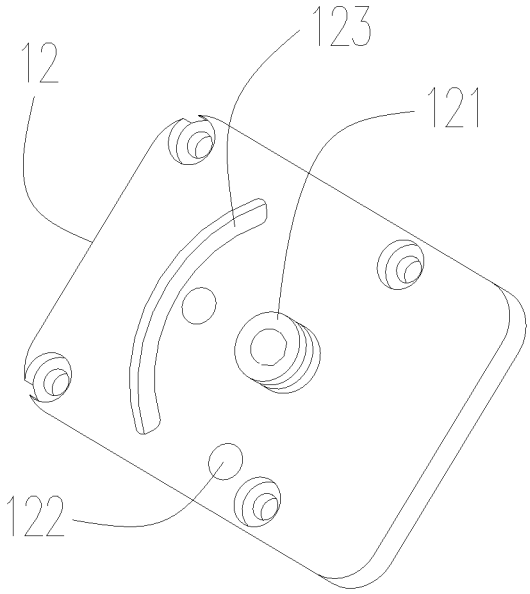
FIG. 5 is a schematic diagram of the structure of the bottom cover in the main body of the electronic cigarette shown in FIG. 1.
Figure 6:
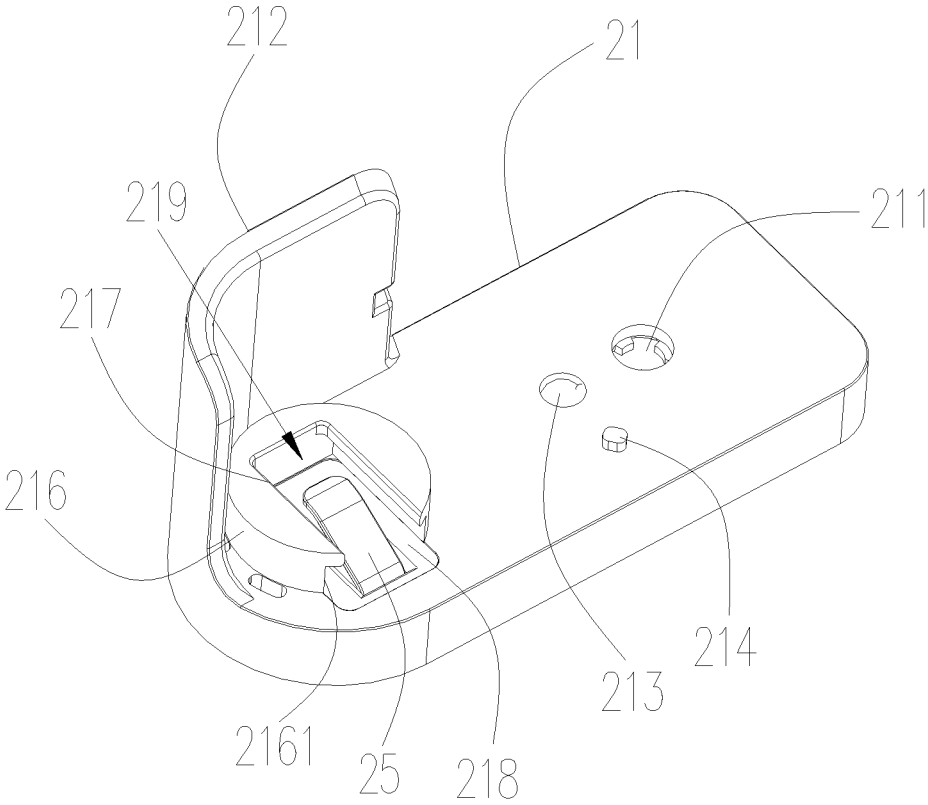
FIG. 6 is a schematic diagram of the structure of the base in the electronic cigarette shown in FIG. 1.

Please refer to FIGS. 5 and 6 at the same time, the base 21 is sustainably a plate-shaped structure. The bottom cover 12 is provided with a rotating shaft 121. The base 21 is provided with a shaft hole 211 corresponding to the rotating shaft 121. The rotating shaft 121 is rotatably connected with the shaft hole 211 so as to realize the rotating connection relationship between the base 21 and the bottom cover 12. The atomizing assembly 30 is installed on the upper surface of the base 21 and can rotate together with the base 21 under the driving of the base 21. The mounting notch 1121 is provided on the path through which the atomizing assembly 30 rotates, so that rotating the base 21 can drive the atomizing assembly 30 to enter the accommodating cavity 110 through the mounting notch 1121, or to move out of the accommodating cavity 110 through the mounting notch 1121.

The upper surface of the base 21 is provided with a blocking wall 212 at one side of the atomizing assembly 30. When the base 21 is rotated until the atomizing assembly 30 enters the accommodating cavity 110, the blocking wall 212 seals the mounting notch 1121. Moreover, a smooth transition is present at the junction between the outer surface of the blocking wall 212 and the outer side of the second casing 112 to match with the overall shape of the main body 10, thereby ensuring the uniformity of the appearance of the electronic cigarette 100 and making it more beautiful. In this embodiment, the blocking wall 212 is a curved side wall provided by protruding upwards from the upper surface of the base 21.

A mounting groove 213 is provided in the upper surface of the base 21, and the mounting groove 213 is a blind groove. The elastic member 22 is installed in the mounting groove 213, one end of the elastic member 22 is connected with the bottom wall of the mounting groove 213 and elastically resisted, and the other end of the elastic member 22 is connected with the locking member 23 and elastically resisted. As a result, the locking member 23 abuts against the bottom cover 12 under the elastic force of the elastic member 22, and there is a rotation resistance between the base 21 and the bottom cover 12, thereby increasing the user's rotation feel and improving the use experience. In addition, two locking grooves 122 are provided in the lower end surface of the bottom cover 12 corresponding to the locking member 23. The locking member 23 rotates together with the base 21 under the driving of the base 21. When the locking member 23 is rotated until it is embedded into one of the locking grooves 122 under the elastic force of the elastic member 22, the atomizing assembly 30 enters the accommodating cavity 110. When the locking member 23 is rotated until it is embedded into the other locking groove 122 under the elastic force of the elastic member 22, the atomizing assembly 30 moves out of the accommodating cavity 110. Through the cooperation of the locking member 23 and the locking groove 122, it is ensured that the atomizing assembly 30 will not move easily after being rotated in place; at the same time, it can also remind the user whether the atomizing assembly 30 is rotated in place or not, which facilitates the user's operation.

In this embodiment, the elastic member 22 is a spring. It is understood that in other embodiments not shown, the elastic member 22 may also be a resilient and rigid element, such as a stainless steel spring sheet, a copper spring sheet, and the like. The locking member 23 is a steel ball.

In addition, the lower end surface of the bottom cover 12 is provided with an arc-shaped limiting groove 123 around the rotating shaft 121, and the upper surface of the base 21 is protruded to provide with a limiting protrusion 214. The limiting protrusion 214 is inserted into the limiting groove 123 and can slide along the limiting groove 123. In the process of rotating the base 21, the limiting protrusion 214 can move from one end of the limiting groove 123 to the other end, thereby limiting the maximal allowable rotation angle of the base 21 to achieve a limiting function for the base 21. It is understood that by rotating the base 21 relative to the bottom cover 12, it is realized that the base assembly 20 is rotated relative to the main body 10.

When installing, the base assembly 20 is rotated, the limiting protrusion 214 moves in the limiting groove 123 from one end to the other end, the locking member 23 moves from one of the locking grooves 122 to the other locking groove 122, and accordingly, the atomizing assembly 30 enters the accommodating cavity 110 through the mounting notch 1121. At this time, the atomizing assembly 30 is installed in place, so that the user can suck.

When disassembling, the base assembly 20 is rotated in the reverse direction, the limiting protrusion 214 moves in the limiting groove 123 from one end to the other end, the locking member 23 moves from one of the locking grooves 122 to the other locking groove 122, and accordingly, the atomizing assembly 30 moves out of the accommodating cavity 110 through the mounting notch 1121. At this time, the user can add the smoke forming substance.

The atomizing assembly 30 includes a smoking pan 31 which can be accommodated in the accommodating cavity 110 and a heating member 32 installed in the smoking pan 31. Specifically, the smoking pan 31 is generally a hollow cylindrical structure with an opening at the upper end, the lower end of the smoking pan 31 is detachably mounted on the upper surface of the base 21. The inner cavity of the smoking pan 31 forms an atomizing chamber 311, and the atomizing chamber 311 is used to retain the smoke forming substance. The heating member 32 is received in the atomizing chamber 311 and is electrically connected to the power supply device 40. In use, the heating member 32 generates heat under the electric driving of the power supply device 40 to heat the smoke forming substance, so that the smoke forming substance is atomized to produce smoke. In addition, the base 21 is further provided with an air inlet opening 215 in communication with the outside environment and the accommodating cavity 110. When the user sucks, external air enters the accommodating cavity 110 through the air inlet opening 215, and then brings the smoke in the atomizing chamber 311 into the user's mouth.

In this embodiment, a fixing seat 216 is provided on the upper surface of the base 21 at one end of the base 21 adjacent to the blocking wall 212. The fixing seat 216 is provided with an electrode groove 219 with a top opening 217 and a side opening 218. An elastic electrode 25 is provided in the electrode groove 219. In one embodiment, the elastic electrode 25 is arranged obliquely upward in a direction away from the side opening 218. The smoking pan 31 of the atomizing assembly 30 is inserted into the fixing seat 216 from the side opening 218. The elastic electrode 25 abuts against the lower end of the smoking pan 31 and is electrically connected to the pin of the heating member 32. The elastic electrode 25 is electrically connected to the power supply device 40, so that when the user activates the electronic cigarette 100, the power supply device 40 can supply power to the heating member 32.

In addition, the bottom of the fixing seat 216 is provided with a latching groove 2161, and the bottom of the smoking pan 31 is protrudingly provided with a buckle (not shown) along the circumference of the smoking pan 31. When the elastic electrode 25 pushes the smoking pan 31 upward from the bottom under the action of the elastic force, the buckle can be engaged with the latching groove 2161 to fix the smoking pan 31. When disassembling the atomizing assembly 30, it is only necessary to slide the smoking pan 31 out along the electrode groove 219 on the fixing seat 216, which is simple and convenient to operate.

Understandably, in other embodiments that are not shown, the atomizing assembly 30 does not use a smoking pan using a solid or semi-solid form of smoke forming substance, but uses an atomizing head using e-liquid.

The electronic cigarette 100 further includes a cigarette lighting device 50 and a first triggering member 60 both of which are installed on the main body 10, and a second triggering member 70 which is installed on the base assembly 20. When the base assembly 20 is rotated until the atomizing assembly 30 is received in the accommodating cavity 110, the first triggering member 60 and the second triggering member 70 form a first relationship of a triggering state, and at this time, when the cigarette lighting device 50 is triggered, the power supply device 40 electrically drives the atomizing assembly 30. When the base assembly 20 is rotated until the atomizing assembly 30 moves out of the accommodating cavity 110, the first triggering member 60 and the second triggering member 70 form a second relationship of a disconnected state, and at this time, even if the cigarette lighting device 50 is triggered, the power supply device 40 cannot electrically drive the atomizing assembly 30.

In this embodiment, the first triggering member 60 is a Hall switch, the second triggering member 70 is a magnetic body. The cigarette lighting device 50, the power supply device 40, the Hall switch and the atomizing assembly 30 are connected in series. The Hall switch is received in the cavity formed by the first casing 111 and the bottom cover 12, and is located below the power supply device 40. The magnetic body is installed on the base 21 corresponding to the Hall switch. When the base assembly 20 is rotated until the atomizing assembly 30 is received in the accommodating cavity 110, the Hall switch and the magnetic body form a first relationship close to each other. At this time, the Hall switch senses that the intensity of the magnetic field of the magnetic body is greater than a threshold, and the Hall switch is closed. When the user triggers the cigarette lighting device 50, the circuit formed by the cigarette lighting device 50, the power supply device 40, the Hall switch and the atomizing assembly 30 which are connected in series is in a conducting state, so the power supply device 40 can electrically drive the atomizing assembly 30. When the base assembly 20 is rotated until the atomizing assembly 30 moves out of the accommodating cavity 110, the Hall switch and the magnetic body form a second relationship far away from each other. At this time, the Hall switch senses that the intensity of the magnetic field of the magnetic body is less than the threshold, and the Hall switch is opened. Even if the user triggers the cigarette lighting device 50, the circuit formed by the cigarette lighting device 50, the power supply device 40, the Hall switch and the atomizing assembly 30 which are connected in series is still in a disconnected state, so the power supply device 40 cannot electrically drive the atomizing assembly 30, thereby avoiding the situation that the user accidentally triggers the cigarette lighting device 50 when filling the smoke forming substance to scald the user. In this embodiment, the triggering state between the first triggering member 60 and the second triggering member 70 refers to the state in which the Hall switch is closed when the Hall switch senses that the intensity of the magnetic field of the magnetic body is greater than a threshold. The disconnected state between the first triggering member 60 and the second triggering member 70 refers to the state in which the Hall switch is opened when the Hall switch senses that the intensity of the magnetic field of the magnetic body is less than the threshold. Understandably, in an embodiment not shown, the first triggering member 60 may also be installed on the bottom cover 12. In this embodiment, the cigarette lighting device 50 is a push-type switch installed outside the first casing 111, and the user presses the push-type switch to realize circuit conduction. Understandably, in other embodiments not shown, the cigarette lighting device 50 may also be a capacitive touch switch, and the user touches the capacitive touch switch to realize circuit conduction. It is also understood that in other embodiments not shown, the cigarette lighting device 50 may also be a sensor, such as an airflow sensor or an air pressure sensor. At this time, the electronic cigarette 100 is provided with a sensing air passage (not shown) and a controller (not shown), wherein the sensor, the power supply device and the controller are electrically connected, and the airflow sensor or the air pressure sensor is installed in the sensing air passage. When the user performs a suction, the airflow sensor or the air pressure sensor can sense the airflow or air pressure change in the sensing air passage, so that the controller controls the power supply device 40 to supply power to the atomizing assembly 30. Understandably, in other embodiments not shown, the cigarette lighting device 50 may also be provided on the base 21 of the base assembly 20.

Understandably, in other embodiments not shown, the first triggering member 60 is installed on the lower surface of the bottom cover 12, and the second triggering member 70 is installed on the upper surface of the base 21. Both the first triggering member 60 and the second triggering member 70 are electrical conductors. The cigarette lighting device 50, the power supply device 40, the two electrical conductors and the atomizing assembly 30 are connected in series. When the base assembly 20 is rotated until the atomizing assembly 30 is received in the accommodating cavity 110, the two electrical conductors form a first relationship of contacting with each other. At this time, when the user triggers the cigarette lighting device 50, the power supply device 40 electrically drives the atomizing assembly 30. When the base assembly 20 is rotated until the atomizing assembly 30 moves out of the accommodating cavity 110, the two electrical conductors form a second relationship of separating from each other. At this time, even if the cigarette lighting device 50 is triggered, the power supply device 40 cannot electrically drive the atomizing assembly 30. Specifically, the triggering state between the first triggering member 60 and the second triggering member 70 refers to the state in which the two electrical conductors are in contact with each other, and the disconnected state between the first triggering member 60 and the second triggering member 70 refers to the state in which the two electrical conductors are separated from each other. Understandably, the electrical conductor includes, but is not limited to, a conductive sheet, a conductive rod, and the like.

In the electronic cigarette 100 of the first embodiment of the present disclosure, by rotating the base assembly 20, the atomizing assembly 30 can be received in the accommodating cavity 110 for the user to inhale, or the atomizing assembly 30 can move out of the accommodating cavity 110 for the user to fill the smoke forming substance, so that the operation is simple and convenient for the user. When the atomizing assembly 30 moves out of the accommodating cavity 110, the first triggering member 60 and the second triggering member 70 are in a second relationship, and at this time, even if the cigarette lighting device 50 is triggered, the power supply device 40 cannot electrically drive the atomizing assembly 30, thereby preventing the user from accidentally triggering the cigarette lighting device 50 to scald the user when the user is filling a smoke forming substance, and achieving a safety protection function.

Second Embodiment

Figure 7:
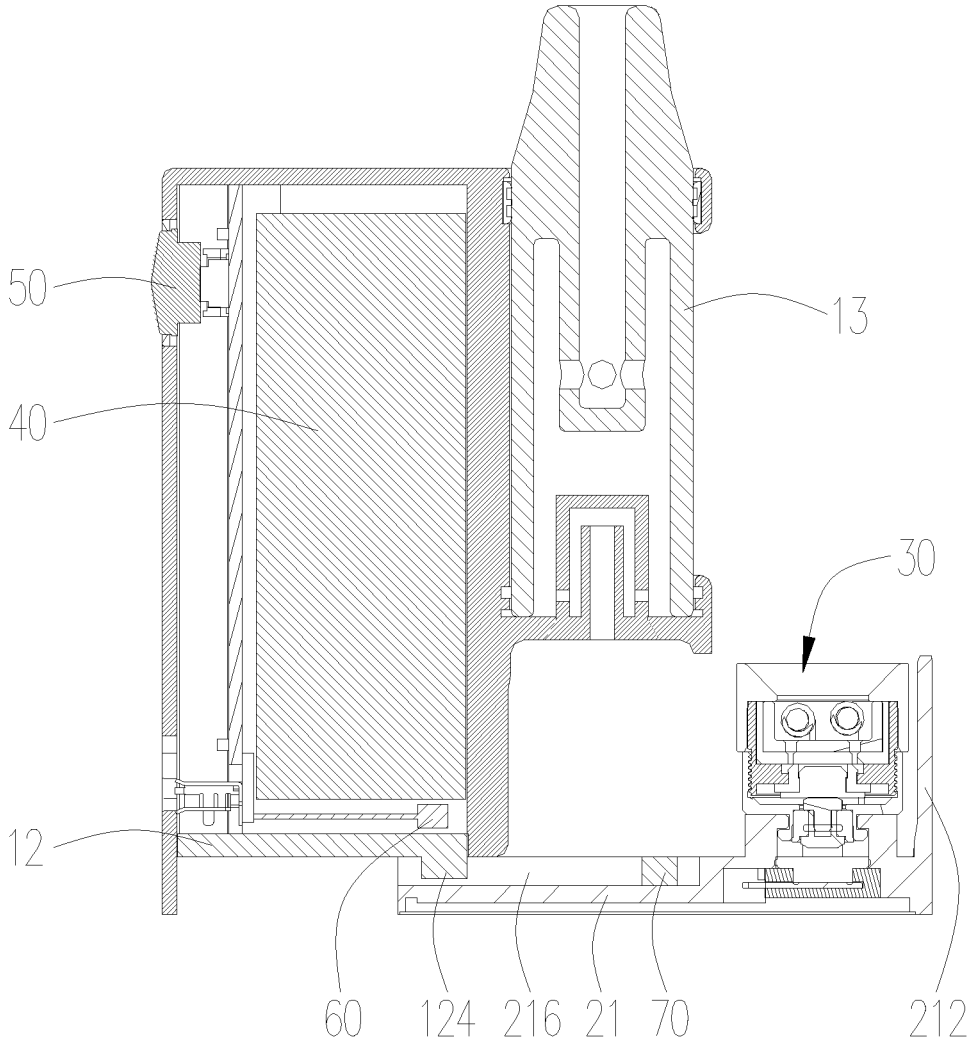
FIG. 7 is a perspective view of the electronic cigarette according to the second embodiment of the present disclosure (showing the state in which the atomizing assembly is moved out of the accommodating cavity).

Please refer to FIG. 7, the difference between the electronic cigarette 200 provided in the second embodiment of the present disclosure and the first embodiment is that: in this embodiment, the base assembly 20 and the main body 10 have different movement modes. Specifically, the base assembly 20 is slidably connected to the main body 10.

The lower surface of the bottom cover 12 protrudes downward to form a sliding block 124, and the upper surface of the base 21 is recessed to form a sliding groove 216 corresponding to the sliding block 124. The sliding block 124 and the sliding groove 216 are slidably connected, so that the base assembly 20 is slidable relative to the main body 10. When installing, the base assembly 20 is cause to slide, and the sliding block 124 moves in the sliding groove 216 from one end to the other end, the atomizing assembly 30 enters the accommodating cavity 110 through the mounting notch 1121 under the driving of the base assembly 20. At this time, the atomizing assembly 30 is installed in place, and the user can perform suction. When disassembling, the base assembly 20 is cause to slide in the opposite direction, and the sliding block 124 moves in the sliding groove 216 from one end to the other end, the atomizing assembly 30 is moved out of the accommodating cavity 110 through the mounting notch 1121 under the driving of the base assembly 20. At this time, the user can perform the operation of adding the smoke forming substance. Correspondingly, the mounting notch 1121 is located on the path through which the atomizing assembly 30 moves.

In addition, the structure and arrangement of the cigarette lighting device 50, the first triggering member 60 and the second triggering member 70 in the first embodiment may also be used in this embodiment to prevent the user from accidentally triggering the cigarette lighting device 50 to scald the user when filling the smoke forming substance, thereby also achieving the safety protection function.

The above-mentioned embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. An electronic cigarette comprising a main body, a base assembly, an atomizing assembly, a power supply device and a cigarette lighting device, wherein:

the main body forms an accommodating cavity therein;

the base assembly is movably arranged on the main body;

the atomizing assembly is connected with the base assembly and is movably received in the accommodating cavity under the driving of the base assembly;

a first triggering member is installed on the main body, a second triggering member is installed on the base assembly;

when the atomizing assembly is received in the accommodating cavity, the first triggering member and the second triggering member form a first relationship of a triggering state;

when the atomizing assembly moves out of the accommodating cavity, the first triggering member and the second triggering member form a second relationship of a disconnected state;

when the first triggering member and the second triggering member are in the triggering state and the cigarette lighting device is triggered at the same time, the power supply device electrically drives the atomizing assembly.

2. The electronic cigarette according to claim 1, wherein the first triggering member is a Hall switch, and the second triggering member is a magnetic body; the cigarette lighting device, the power supply device, the Hall switch and the atomizing assembly are connected in series; when the first triggering member and the second triggering member switch from the second relationship to the first relationship, the magnetic body gradually approaches the Hall switch and triggers the Hall switch to be closed.

3. The electronic cigarette according to claim 1, wherein both the first triggering member and the second triggering member are electrical conductors; the cigarette lighting device, the power supply device, the two electrical conductors and the atomizing assembly are connected in series; when the two electrical conductors gradually approach and then come into contact with each other, the first triggering member and the second triggering member switch from the second relationship to the first relationship.

4. The electronic cigarette according to claim 1, wherein the main body comprises a bottom cover, the base assembly comprises a base, the first triggering member is installed on the bottom cover, the second triggering member is installed on the base, the base is slidable or rotatable relative to the bottom cover.

5. The electronic cigarette according to claim 4, wherein a rotating shaft is provided on the bottom cover, a shaft hole is provided in the base corresponding to the rotating shaft, the rotating shaft is rotatably connected with the shaft hole; or, a sliding block is provided on the bottom cover, a sliding groove is provided in the base corresponding to the sliding block, the sliding block is slidably connected with the sliding groove.

6. The electronic cigarette according to claim 4, wherein the cigarette lighting device is a push switch or a capacitive touch switch installed outside the main body; or, the electronic cigarette is provided with a sensing air passage and a controller, the cigarette lighting device is a sensor installed in the sensing air passage, wherein the sensor, the power supply device and the controller are electrically connected.

7. The electronic cigarette according to claim 4, wherein the main body is provided with a mounting notch communicating with the accommodating cavity, the atomizing assembly enters the accommodating cavity through the mounting notch or moves out of the accommodating cavity through the mounting notch; a blocking wall is provided on the base; the blocking wall is capable of sealing the mounting notch; a smooth transition is present at the junction between the outer surface of the blocking wall and the outer surface of the main body to match with the overall shape of the main body.

8. The electronic cigarette according to claim 4, wherein the main body further comprises a housing, the housing comprises a first casing and a second casing provided on one side of the first casing, the bottom cover is installed in an opening at the lower end of the first casing, a cavity for receiving the power supply device is enclosed jointly by the bottom cover and the first casing; the cigarette lighting device is provided on the first casing, the accommodating cavity is provided in the second casing.

9. The electronic cigarette according to claim 1, wherein the atomizing assembly comprises a smoking pan configured to be received in the accommodating cavity, an atomizing chamber is provided in the smoking pan, the main body comprises a smoke outlet pipe in communication with the accommodating cavity.

10. The electronic cigarette according to claim 9, wherein the lower end surface of the smoke outlet pipe extends upward along the axial direction of the smoke outlet pipe to form an inner sleeve and an outer sleeve sleeved on the outside of the inner sleeve; a smoke outlet passage is formed between the inner sleeve and the outer sleeve; the lower end of the inner sleeve is in communication with the accommodating cavity; the upper end of the inner sleeve is in communication with the smoke outlet passage; the outer sleeve is provided with a smoke outlet opening in communication with the smoke outlet passage and the inner cavity of the smoke outlet pipe.

11. An electronic cigarette comprising a main body, a base assembly and an atomizing assembly, wherein:

the main body comprises a bottom cover, the bottom cover is installed at a lower end of the main body;

the base assembly comprises a base, the base is located below the bottom cover, the atomizing assembly is installed on the base;

an accommodating cavity configured for receiving the atomizing assembly is provided inside the main body, a side wall of the main body is provided with a mounting notch communicating with the accommodating cavity, a blocking wall corresponding to the mounting notch is provided on the base;

the base is rotatable or slidable relative to the bottom cover to switch between a first position and a second position;

in the first position, the atomizing assembly is received in the accommodating cavity and the blocking wall seals the mounting notch;

in the second position, the atomizing assembly is located out of the accommodating cavity for being filled with a smoke forming substance;

when the base rotates or slides relative to the bottom cover to switch between the first position and the second position, the atomizing assembly is driven by the base to enter the accommodating cavity through the mounting notch or move out of the accommodating cavity through the mounting notch.

12. The electronic cigarette according to claim 11, wherein a rotating shaft is provided on one of the bottom cover and the base, a shaft hole corresponding to the rotating shaft is provided in the other of the bottom cover and the base, the rotating shaft is rotatably inserted in the shaft hole.

13. The electronic cigarette according to claim 12, wherein a mounting groove is provided in an upper surface of the base, the mounting groove is a blind groove, the base assembly further comprises an elastic member and a locking member, the elastic member is installed in the mounting groove, one end of the elastic member is connected with a bottom wall of the mounting groove, and the other end of the elastic member is connected with the locking member, two locking grooves are provided in a lower surface of the bottom cover, the locking member rotates together with the base under the driving of the base;

when the locking member is rotated until it is embedded into one of the locking grooves, the atomizing assembly enters the accommodating cavity;

when the locking member is rotated until it is embedded into the other locking groove, the atomizing assembly moves out of the accommodating cavity.

14. The electronic cigarette according to claim 13, wherein the lower surface of the bottom cover is provided with an arc-shaped limiting groove around the rotating shaft, the upper surface of the base is protruded to provide with a limiting protrusion, the limiting protrusion is inserted into the limiting groove and can slide along the limiting groove;

when the base is rotated relative to the bottom cover, the limiting protrusion moves from one end of the limiting groove to the other end of the limiting groove.

15. The electronic cigarette according to claim 11, wherein a sliding block is provided on one of the bottom cover and the base, a sliding groove corresponding to the sliding block is provided in the other of the bottom cover and the base, the sliding block is slidably disposed in the sliding groove.

16. The electronic cigarette according to claim 11, wherein the main body comprises a first casing and a second casing provided on one side of the first casing, the bottom cover is installed in an opening at the lower end of the first casing, a cavity for receiving a power supply device is enclosed jointly by the bottom cover and the first casing; the accommodating cavity is provided inside the second casing; a lower end of the second casing is flush with the lower end of the first casing, the height of the second casing is smaller than the height of the first casing; the main body further comprises a smoke outlet pipe located above the second casing and in communication with the accommodating cavity.

17. The electronic cigarette according to claim 11, wherein the main body is provided with a first triggering member, the base assembly is provided with a second triggering member;

when the base rotates or slides relative to the bottom cover to switch from the second position to the first position, the second triggering member gradually approaches the first triggering member to cause the first triggering member to be closed or to contact with the first triggering member;

when the base rotates or slides relative to the bottom cover to switch from the first position to the second position, the second triggering member gradually moves away from the first triggering member to cause the first triggering member to be opened or to not contact with the first triggering member.

18. The electronic cigarette according to claim 17, further comprising a power supply device received in the main body, wherein:

in the first position, the first triggering member and the second triggering member are in a connected state so that the atomizing assembly is electrically connected to the power supply device;

in the second position, the first triggering member and the second triggering member are in a disconnected state so that the atomizing assembly is disconnected from the power supply device.

19. The electronic cigarette according to claim 18, further comprising a cigarette lighting device provided on the main body, wherein:

in the first position, when the cigarette lighting device is triggered, the atomizing assembly is driven by the power supply device to atomize and form smoke;

in the second position, even if the cigarette lighting device is triggered, the atomizing assembly is not able to be driven by the power supply device to atomize and form smoke.

20. The electronic cigarette according to claim 17, wherein the first triggering member is a Hall switch, and the second triggering member is a magnetic body; or the first triggering member and the second triggering member are both electrical conductors.

* * * * *